United States Patent [19]

Mansfield et al.

[11] Patent Number: 4,749,383

[45] Date of Patent: Jun. 7, 1988

[54] METHOD FOR PRODUCING LOW AND MEDIUM BTU GAS FROM COAL

[75] Inventors: Vaughn Mansfield, Gallatin; Christopher M. Francoeur, Nashville, both of Tenn.

[73] Assignee: Mansfield Carbon Products, Nashville, Tenn.

[21] Appl. No.: 870,741

[22] Filed: Jun. 4, 1986

[51] Int. Cl.[4] ..... C10J 3/16

[52] U.S. Cl. ..... 48/202; 48/203; 48/206

[58] Field of Search ..... 48/202, 203, 206; 201/32; 110/229, 230

[56] References Cited

U.S. PATENT DOCUMENTS

| | | | |
|---|---|---|---|
| 1,832,092 | 11/1931 | Burnside | 48/203 |
| 1,861,452 | 6/1932 | Rusby et al. | 48/DIG. 4 |
| 3,009,795 | 11/1961 | Atwell | 48/206 |
| 3,560,347 | 2/1971 | Knapp et al. | 201/32 |
| 4,109,590 | 8/1978 | Mansfield | 48/206 |
| 4,220,454 | 9/1980 | Ban et al. | 48/202 |
| 4,372,756 | 2/1983 | Whitten et al. | 48/202 |
| 4,417,528 | 11/1983 | Vining et al. | 110/229 |

*Primary Examiner*—Peter Kratz

*Attorney, Agent, or Firm*—Nies, Webner, Kurz & Bergert

[57] ABSTRACT

Coal is transported through a hot carbonizing furnace chamber successfully on two endless traveling chain grates, the first of which is higher than the second and the second being run at a slower speed than the first so as to form a thicker bed than the coal on the first grate. Air is fed through the coal on the first grate in sub-stoichiometric amounts at low velocity so as to drive off the volatiles while air and steam are fed to the coal in the second grate in amounts sufficient to burn the coal. Gaseous by-products are exhausted from the furnace chamber and ashes are discharged through a conventional take-off.

5 Claims, 1 Drawing Sheet

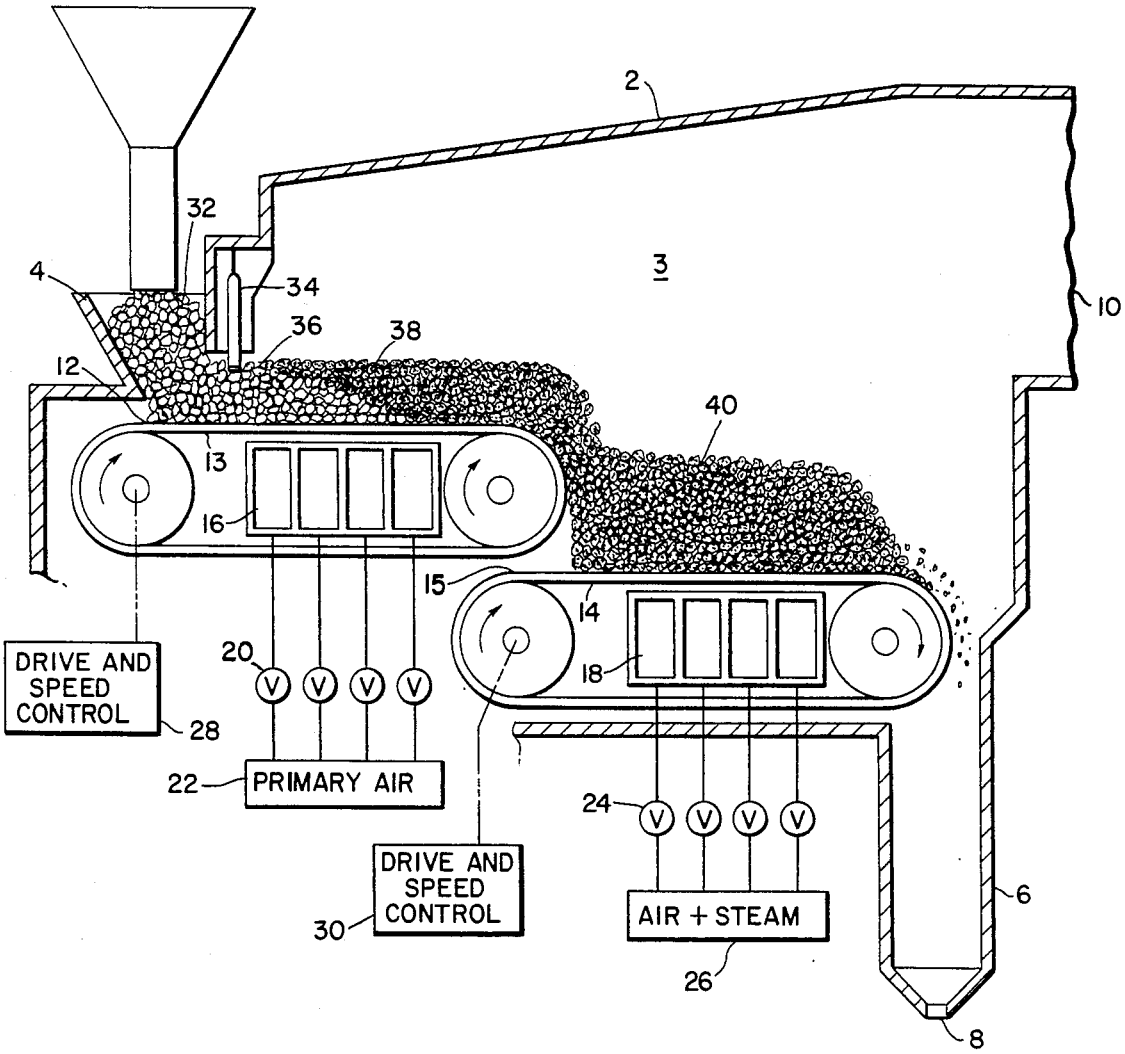
2
32
4
34
36
38
3
10
12
40
13
16
15
14
18
DRIVE AND SPEED CONTROL
28
20
V
22
PRIMARY AIR
24
DRIVE AND SPEED CONTROL
30
AIR + STEAM
26
6
8

METHOD FOR PRODUCING LOW AND MEDIUM BTU GAS FROM COAL

PRIOR ART

U.S. Pat. No. 4,109,590 to Vaughn Mansfield—Aug. 29, 1978.

U.S. Pat. Nos. 4,372,756 to Whitten, Scott and Mansfield and Vining and Smith 4,417,528.

BACKGROUND AND OBJECTS

In the prior art (supra) gas was produced from coal by first passing a bed of coal through a furnace on a moving grate and then letting it move downwardly through a shaft furnace and thence into a fixed bed gasifier. The coal on the moving grate was air starved, most of the volatiles were driven off and a minimum of fixed carbon was burned. The off gases were downdrafted through the coal in the shaft furnace, air and steam were fed to the coal in the fixed bed gasifier and the off gases from the shaft furnace in the fixed bed gasifier were drawn off for utilization in a boiler. While the prior art processes offered many advantages, the capital costs were high. The object now is to produce comparable reactions, the same efficient utilization of the coal and equal amounts and quality of the gaseous end products, but with far less capital costs. By this invention, the shaft furnace and the fixed bed gasifier are eliminated and the process is carried out in a single furnace chamber. The coal is continuously transported on two moving grates, a first one higher than the second such that the coal from the first grate discharges onto the second. The grate speeds are so regulated that the bed transported on the first or higher grate is relatively thin while the bed on the lower grate is relatively thick. The reactions are detailed in the following summary of the invention and in the apparatus shown in the drawing, in which the sole FIGURE is a diagramatic cross section through the furnace in which the process is carried out.

SUMMARY OF THE INVENTION

Coal and/or other carbonizable material is devolatilized on a moving grate with a sub-stoichiometric quantity of combustion air. Seventy-five to eighty percent of the volatile matter is driven off on the first grate in the starved combustion section. The now incandescent coke is discharged onto the second moving grate in the gasification section. The second grate moves forward at a slower speed than the first creating a thick bed of incandescent coke. Air and steam or oxygen and steam are fed in controlled amounts through the thick bed via the stoker air distribution system.

The reaction rate through the first grate run is controlled by varying the fuel-to-combustion air ratio. The velocity of the starved, combustion air through a fuel bed is very low to prevent fluidization of small particles into the gas stream. The air is supplied in sub-stoichiometric quantities driving the following reactions:

$$C+O_2=CO_2 \quad (1)$$

$$2C+O_2=2CO \quad (2)$$

Bed temperature is controlled by adjusting the air flow through each independent supply zone to yield a homogeneous bed of incandescent coke at the end of the first grate. A $CO/CO_2$ analyzer monitors the product gases evolved and adjusts the air supply to optimize the production of CO over $CO_2$ (equation 2).

The reaction rate through the second grate run is controlled by the quantity and ratio of steam to air or of steam to oxygen to obtain the following reactions:

$$2C+O_2=2CO \quad (2)$$

$$C+H_2O=H_2+CO \quad (3)$$

$$C+2H_2O=2H_2+CO_2 \quad (4)$$

$$CO+H_2O=H_2+CO_2 \quad (5)$$

Blast saturation temperature is maintained within the bed of incandescent coke on the second grate to prevent clinkering of the ash and to keep the grate keys cool. The mass ratio of steam to hot, incandescent coke is in a range of 0.4 to 0.6. Gas quality is maximized when the steam-to-coke ratio is in this range.

Ash is discharged at the end of the second grate run.

DETAILED DESCRIPTION

Referring now to the drawing, the sole FIGURE shows a furnace 2 with a chamber 3 having input hopper 4 at an input end, and ash pit 6 at the output end, the ash pit having a discharge 8 which may have a conventional air lock, screw, conveyor discharger, etc. The gaseous output is discharged through a flue 10 which is connected to a boiler or like heat recovery device (not shown). The coal is transported through the furnace on two successive bar and key traveling grates, the first grate 12 having its upper run 13 considerably higher than the upper run 14 of the second chain grate 15. Beneath the upper grate runs are zoned air boxes 16 and 18, the air feed to which is controlled by valves 20 through binds leading from a source of primary air 22. The feed to the air boxes 18 are controlled by valves 24 in lines leading from a source of air and steam 26. Suitable controls (not shown) may be provided to control the ratio of air to steam. The traveling grates are conventionally driven by drive mechanisms which include speed controls diagramatically indicated at 28 and 30. Coal 32 is fed via input hopper 4 onto the upper run 13 of the first stoker grate 12 and spread to form a bed by conventional spreader gate 34 which establishes the thickness of bed 36 on the upper run of stoker grate 12. As the coal moves through the hot furnace chamber it ignites as indicated by the darker portions 38 until, at the end of grate run 13, it is fully ignited from top to bottom. Grate 15 is run at a lower speed than grate 12 so that the bed 40 is much thicker than 36. At the end of the run 14 of grate 15, the coal has been fully burned and dropped into ash pit 6.

While the dimensions may vary according to the type of coal and gaseous output desired, in a typical example, each grate run would be about 4 feet wide, the length of the first grate run would be about 8 feet and the second grate run would be about 6 feet and the thickness of the bed on the first grate run would be about 5 inches while the bed on the second grate run would be about 24 inches. The depth of the bed on the first grate run must be kept relatively thin to prevent clinkering of the coal or carbonized material. Furthermore, the first bed must be supplied a limited amount of combustion air so as to avoid overcarbonization or fluidization of any part of the bed. The first grate run destroys any caking qualities of the coal being carbonized which subsequently prevents clinkering on the second, thicker bed of incandescent coke. The relatively thick bed on the second grate promotes good gasification reactions that cannot be attained on the thin bed of the first run. When the coal reaches the end of the first grate run, it is fully ignited and has achieved a temperature of about 1800° F., while the temperature of the coal on the second grate run may be somewhat less than 1800° F. because of the quenching effect of the steam. At the end of the first grate run, seventy-five to eighty percent of the volatile matter in the coke will have been driven off and at the end of the second grate run, the coke will have been fully burned and the discharge into the ash pit will be virtually all ash.

In the foregoing specification and ensuing claims where the feed of air and steam to the coke on the second grate run is described, it is understood that the term "air" includes - oxygen - rather than air.

We claim:

1. A process for producing low and medium BTU gas from carbonizable material which comprises:

partly devolatizing said material and forming hot incandescent coke therefrom by passing a bed of the same part way through a hot furnace chamber on a first horizontally moving grate while supplying a sub-stoichiometric quantity of air to the same and driving the reactions:

$$C+O_2=CO_2$$

$$2C+O_2=2CO$$

discharging the hot incandescent coke from the end of the first grate run onto a second horizontally moving grate run below the first grate run in the same furnace chamber so as to form a bed thereon, the bed formed on the second grate run being considerably thicker than the bed formed on the first grate run, passing the hot incandescent coke bed on the second grate run further through the furnace chamber in a substantially horizontal direction while feeding air and steam thereto so as to fully burn the coke and in ratio of steam to air driving the following reactions:

$$2C+O_2=2CO$$

$$C+H_2O=H_2+CO$$

$$C+2H_2O=2H_2+CO_2$$

$$CO+H_2O=H_2+CO_2$$

taking off the ash residue of the burned coke and taking off the gaseous products of said reactions.

2. The process claimed in claim 1, wherein the relatively greater thickness of the bed on the second grate run is obtained by running the second grate run slower than the first grate run.

3. The process as claimed in claim 1, wherein the mass ratio of steam to hot incandescent coke is in the range of 0.4–0.61.

4. The process claimed in claim 1, wherein the velocity of air fed to the material on the first grate run is less than that required to elevate the material from the bed.

5. The process claimed in claim 1, wherein the velocity of air and steam fed to the hot incandescent coke on the second rate run is so controlled as to maintain blast saturation temperature in the coke whereby to prevent clinkering of the coke.

* * * * *

UNITED STATES PATENT AND TRADEMARK OFFICE

CERTIFICATE OF CORRECTION

PATENT NO. : 4,749,383

DATED : June 7, 1988

INVENTOR(S) : Vaughn Mansfield and Christopher Francoeur

It is certified that error appears in the above-identified patent and that said Letters Patent is hereby corrected as shown below:

IN THE CLAIMS:

Column 4, claim 3, line 27, "0.4-0.61"

should read --0.4-0.6--.

Signed and Sealed this

Thirteenth Day of December, 1988

*Attest:*

DONALD J. QUIGG

*Attesting Officer*

*Commissioner of Patents and Trademarks*